US005661849A

United States Patent [19]

Hicks

[11] Patent Number: 5,661,849

[45] Date of Patent: Sep. 2, 1997

[54] PROTECTIVE FACE GUARD FOR SOFTBALL PLAYERS

[76] Inventor: Lonnie G. Hicks, 7014 62nd Place NE., Marysville, Wash. 98270

[21] Appl. No.: 687,653

[22] Filed: Jul. 26, 1996

[51] Int. Cl.[6] ..... A42B 3/00

[52] U.S. Cl. ..... 2/9; 2/424

[58] Field of Search ..... 2/9, 10, 424, 425, 2/410, 411, 422

[56] References Cited

U.S. PATENT DOCUMENTS

| | | | |
|---|---|---|---|
| 3,729,746 | 5/1973 | Humphrey . | |
| 4,633,531 | 1/1987 | Nimmons . | |
| 4,933,993 | 6/1990 | McClelland | 2/424 |
| 5,477,565 | 12/1995 | Hunt, Jr. | 2/424 |

OTHER PUBLICATIONS

Schutt Manufacturing Co., Litchfield, IL 62056; Schutt Batter's Guard Mounting Instructions; Apr. 1995.

U.S. Consumer Product Safety Commission, Office of Information and Public Affairs, Washington, DC 20207; CPSC Releases Study of Protective Equipment for Baseball; Release #96–140, Jun. 4, 1996.

BSN Sports, Atlanta; MacGregor baseball batters' helmets and face shield catalog publication; 1996.

*Primary Examiner*—Michael A. Neas

*Attorney, Agent, or Firm*—Townsend and Townsend and Crew

[57] ABSTRACT

A protective face guard for use with a baseball helmet to prevent facial injuries during softball activities. The face guard is made of rigid, curved bars interconnected by vertical struts to form a concave shield around a player's face. The guard has a downwardly oriented visual aperture corresponding to a clear tracking field of sight for softball players to visually track a pitched softball approaching from a low pitched ball release point. The visual aperture is bounded by a frontal portion of one bar member positioned near the player's eyebrow ridge, approximately an inch or less below the brim of the helmet, and by a frontal portion of a lower bar member positioned about three inches below that level. In conjunction with this novel bar and aperture configuration, the vertical strut members above and below the visual aperture can be located forward of the strut members that span the visual aperture, and preferably lateral to a frontal midline of the face guard.

7 Claims, 5 Drawing Sheets

PROTECTIVE FACE GUARD FOR SOFTBALL PLAYERS

TECHNICAL FIELD

The invention relates to protective face guards for use in sporting activities. More specifically, the invention relates to protective face guards attachable to batting helmets for shielding against facial injury during softball play.

BACKGROUND OF THE INVENTION

In the sport of baseball, a primary concern of players, parents and coaches is to avoid injuries that can result when a player is struck by an errant pitch, hit or throw. The hardness of regulation baseballs and the exceedingly high ball speeds achieved in both professional and amateur play pose a substantial threat of serious injury in cases where a player is struck in a vulnerable area, particularly the head. To reduce the risk of head injuries in general, most baseball leagues and institutions recommend or require the use of an impact resistant helmet, at least during batting activities. In addition, a face guard is generally employed which attaches to the batting helmet and provides an impact resistant shield to protect against facial, dental and eye injuries.

A large variety of face guards have been developed during the long history of baseball. The design of these face guards generally includes a stiff guard member that rigidly attaches to a batting helmet and serves to deflect hit or thrown balls from the face of the wearer. Representative prior art patents describing such masks include U.S. Pat. Nos. 3,196,45, 2,616,81 and 1,488,812. Such face guards can be made from a variety of possible materials, including plastics, nylon, steel, cast aluminum and other rigid, impact resistant materials. In one design, disclosed in U.S. Pat. No. 4,633,531 and manufactured by Schutt (Litchfield, Ill.), a grid-like arrangement of sturdy metal segments is welded to form a unitary mask. The mask is generally concave and mounts to the helmet at the front of the ear flags and along the front of the helmet brim. In another design, disclosed in U.S. Pat. No. 3,886,596, the face guard is comprised of a clear shield of high impact plastic which wraps around the lower portion of the face and connects to the ear flags.

Despite the widespread development and use of protective face guards in the sport of baseball, the practice of wearing face guards has only recently begun to catch hold in the distinct sport of softball. To date it has been widely perceived that the risk of facial injury from ball impacts in softball is minimal, in view of the lower durometer, or hardness, of softballs compared to regulation baseballs, and based on the comparatively low pitch speeds achieved in softball. However, these perceptions are largely misguided, because the hardness of softballs often approaches that of regulation baseballs, and the increased weight of softballs over hardballs can create substantial impact forces. Moreover, the growing sport of fast pitch softball has become increasingly more refined and competitive, and the speeds of pitched and hit balls on the softball field have become nearly as formidable as those on the baseball field. To illustrate this point, the record speed in women's fast pitch softball, currently held by Michelle Smith of the U.S. Olympic Team, tops 70 mph. At such speeds, and considering the heavy mass of softballs, the need for protective face gear can no longer be taken lightly.

The need for facial protective head and face gear in softball has recently been underscored by the U.S. Consumer Product Safety Commission, which released a 1996 report detailing baseball and softball related injuries in children. The CPSC report indicates that ball impacts to the head accounted for 21 deaths of children between 1973 and 1995. In addition, there were 47,900 children treated for ball impact injuries to the head and neck, 35,200 of whom sustained facial injuries. These injuries were largely avoidable, and the CPSC found that helmets equipped with face guards should prevent, reduce or lessen the severity of about 3,900 facial injuries occurring to batters in organized play each year.

Because of the growing concern over facial injuries in softball, and due in part to the fact that softball has experienced recent growth and widespread institutionalization, it is now more common to see players, especially children in organized leagues, wearing protective face gear. The inventor of the present invention has been on the cutting edge of this development through his operation of summer softball camps for children and young adults. As is true of other top level training institutions, the inventor's camps place extreme emphasis on player safety. As part of this safety emphasis, all players are advised to wear a protective face mask at bat and during other high risk periods of play.

The selection of protective face guards for softball players has been limited to available face guards designed for baseball, described above. Baseball face guards have been accepted for use by softball players, and are generally considered to satisfy the critical safety concerns at issue. Namely, baseball safeguards adequately exclude errant softballs from striking the eyes, nose, cheeks or teeth of players. However, baseball face guards suffer a number of drawbacks when used for softball activities. Among these drawbacks, the inventor has observed during the course of recent softball training exercises that players who wear baseball face guards exhibit frequent head movements, characterized by repeated lowering and raising of the chin, during the course of batting activities. Such frequent head adjustments are undesirable, and generally interfere with the development of consistent batting posture and swing. After extensive observations and student interviews, the inventor determined that conventional baseball face guards unduly obstruct the vision of softball players, because the configuration of wire grid elements on baseball face guards partially interferes with a player's line of sight to visually track the ball after it is released by the pitcher. In softball, a player's line of sight to the pitcher's ball release position is downward, because the ball is released from a level mound near the pitcher's thigh and generally approaches the batter along an upward path. In baseball the opposite is true. The player's line of sight to the ball release position is upward, because the ball is typically released from about the level of the pitcher's head from an elevated mound and approaches the batter along an downward path.

In addition to imposing visual obstruction, baseball face guards are also poorly adapted for softball because the size and placement of grid elements are not specifically developed in light of the distinct ball size, pitched ball travel path and other unique attributes of the sport of softball.

In view of the above, a need exists in the art for a face guard that provides reliable protection against facial injuries from errant softball impacts, but which imposes minimal interference with visibility during softball play. Such a face guard will desirably incorporate structural concepts developed based on the distinct ball size, pitched ball travel path and other unique attributes of the sport of softball. The face guard should provide a complete structural barrier to softball penetration surrounding a player's face, but be light weight and strategically reinforced to minimize visual obstruction and reduce material and manufacturing costs. Likewise, the face guard should be constructed of strong material that resists distortion under heavy impact, but which is inexpensive and convenient to use in manufacturing the face guard. In addition, the face guard should be readily and securely attachable to a standard baseball helmet in such a manner to reduce the risk of breakage at attachment points, and to allow for quick removal of the face guard in the event of medical injury.

SUMMARY OF THE INVENTION

It is therefore an object of the present invention to provide a face guard that reliably protects against facial injuries from errant softball impacts, while at the same time imposing minimal interference with visibility during softball play.

It is another object of the invention to provide a face guard for use by softball players that incorporates novel structural elements based on the distinct ball size, pitched ball travel path and other unique attributes of the sport of softball.

It is further object of the present invention to satisfy the above objects in a face guard that provides a complete structural barrier to softball penetration surrounding a player's face, but which is light weight and strategically reinforced to minimize visual obstruction while resisting distortion under heavy impact, and to reduce material and manufacturing costs.

It is yet another object of the invention to provide a softball face guard that is readily and securely attachable to a standard baseball helmet in such a manner to absorb shock and reduce the risk of helmet breakage at attachment points, and to allow for quick removal of the face guard in the event of medical injury.

The invention achieves these objects and other objects and advantages which will become apparent from the description which follows by providing a protective face guard made of rigid, curved bar members interconnected by vertical struts to form a concave shield that is securely mountable to a baseball helmet. The bar members of the face guard define a downwardly oriented visual aperture when the guard is mounted to the helmet and the helmet is correctly seated on the player's head, which aperture provides a clear tracking field of sight for the player to visually track a softball approaching the player along an upward path from a point of pitched ball release. In one example for achieving this aperture design, a frontal portion of one bar member marking an upper boundary of the visual aperture is vertically positioned at about the same vertical height as a player's eyebrow ridge, approximately an inch or less below the brim of the helmet when the face guard and helmet are correctly mounted and seated. A lower bar member is positioned about 3 to 3¼ inches below this upper boundary level and marks the lower boundary of the visual aperture.

In conjunction with its novel bar and visual aperture configuration, the face guard of the invention also includes novel vertical strut members located above and below the visual aperture which can be located forward of the strut members that span the visual aperture, and preferably lateral to a frontal midline of the face guard.

DETAILED DESCRIPTION OF THE INVENTION

Figure 1:
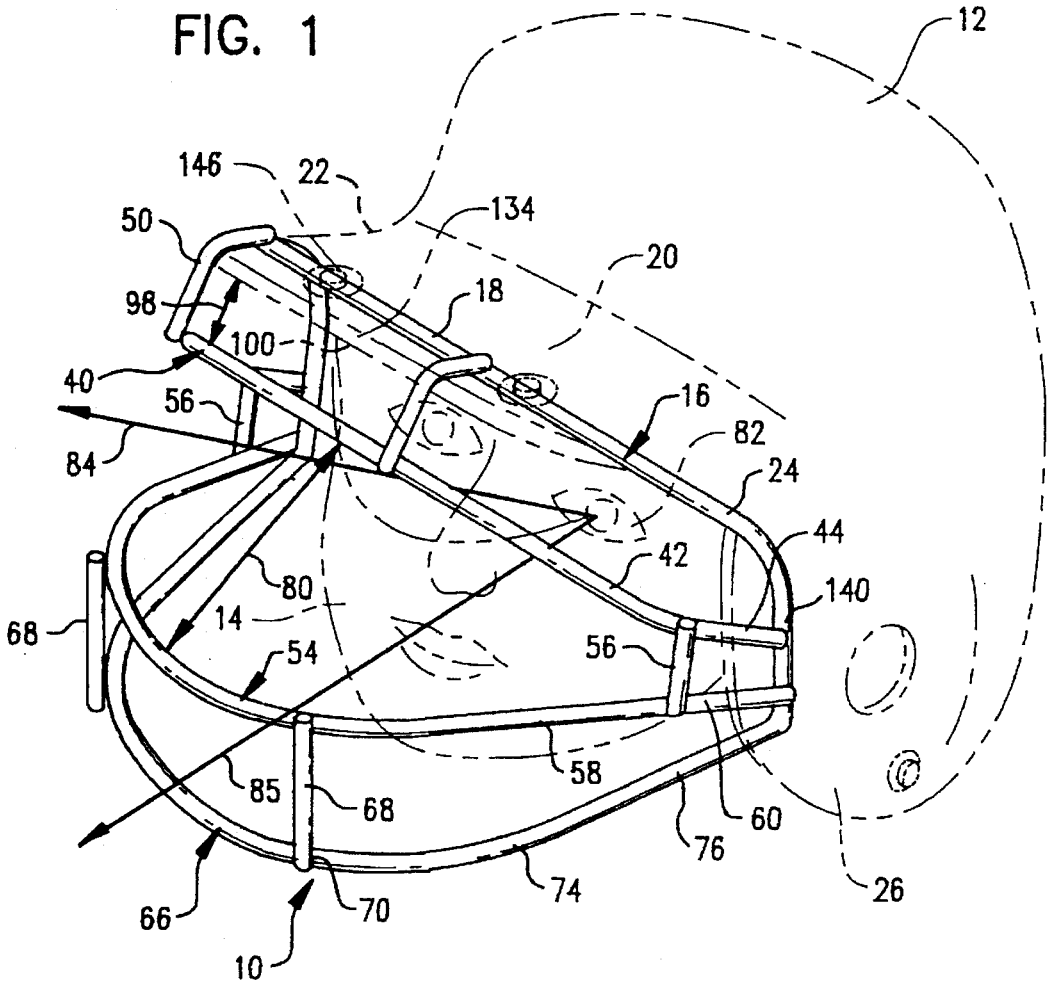
FIG. 1 is a front right perspective view of a softball face guard employing the concepts of the invention.

A protective softball face guard 10 employing the concepts of the present invention is generally depicted in FIG. 1, which shows the face guard attached to a conventional batter's helmet 12 correctly seated on a softball player's head 14. The face guard is preferably in the form of a shield like grid having a first bar member made of a rigid, impact resistant material. The first bar member has a generally semicircular first bar member frontal portion 18 adapted to seat atop an upper surface 20 of a frontally extending brim 22 of the baseball helmet when the face guard is correctly mounted to the helmet, as shown. The first bar member also includes rearwardly extending first bar member rear leg portions 24 extending rearwardly from the first bar member frontal portion beyond the brim in close juxtaposition to paired lateral ear flags 26 of the helmet when the face guard is mounted to the helmet.

Situated below the first bar member 18 is a second bar member 40 also made of a rigid, impact resistant material (See FIGS. 1 and 2). The second bar member features a generally semicircular second bar member frontal portion 42 which is positioned below the brim 22 when the face guard 10 is mounted to the helmet 12, and rearwardly extending second bar member rear leg portions 44 extending rearwardly from the second bar member frontal portion beyond the brim in close juxtaposition to the paired lateral ear flags 26 when the face guard is mounted to the helmet. The first bar member and second bar member are rigidly interconnected by at least one first tier vertical strut member 50 that is welded, glued, integrally cast or otherwise connected at first tier vertical strut member junction points 52 between the first and second bar members.

A third bar member 54 made of rigid, impact resistant material is positioned below the second bar member 40 and is rigidly connected thereto by at least one second tier vertical strut member 56, in the same manner as the first tier strut member 50 is interconnected between the first bar member 18 and second bar member 40. The third bar member has a generally semicircular third bar member frontal portion 58 and rearwardly extending third bar member rear leg portions 60 extending rearwardly from the third bar member frontal portion beyond the brim 22 in close juxtaposition to the paired lateral ear flags 26 when the face guard 10 is mounted to the helmet 12.

For increased protection against facial injury it is preferable to include a fourth bar member 66 configured and dimensioned to extend below the third bar member 54 and thereby form a more complete shield surrounding the player's face, including the eyes cheeks and chin areas. As with the remaining structural elements of the face guard 10, the fourth bar member is also made of a rigid, impact resistant material. To secure the fourth bar member against deflection or deformation due to impact with a softball or other object or surface, the fourth bar member is also anchored by an interconnecting strut member; namely at least one third tier vertical strut member 68 interconnecting the fourth bar member with the third bar member at third tier vertical strut member junction points 70. As with the other bar members, the fourth bar member has a generally semicircular fourth bar member frontal portion 74 and rearwardly extending fourth bar member rear leg portions 76 extending rearwardly from the fourth bar member frontal portion beyond the brim 22 in close juxtaposition to the paired lateral ear flags 26 when the face guard is correctly mounted to the helmet 12.

Figure 2:
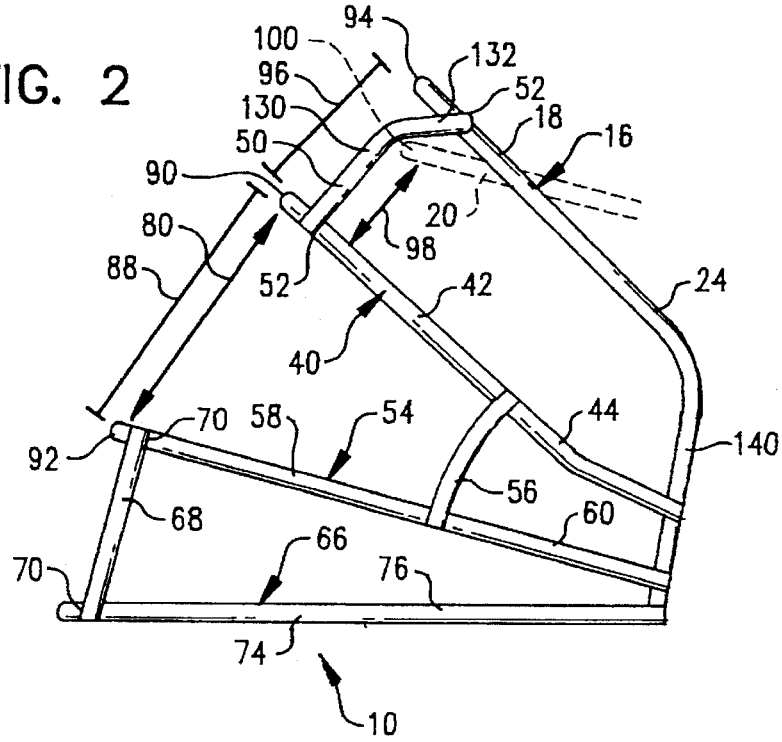
FIG. 2 is a right side elevational view of the softball face guard of FIG. 1.
Figure 3:
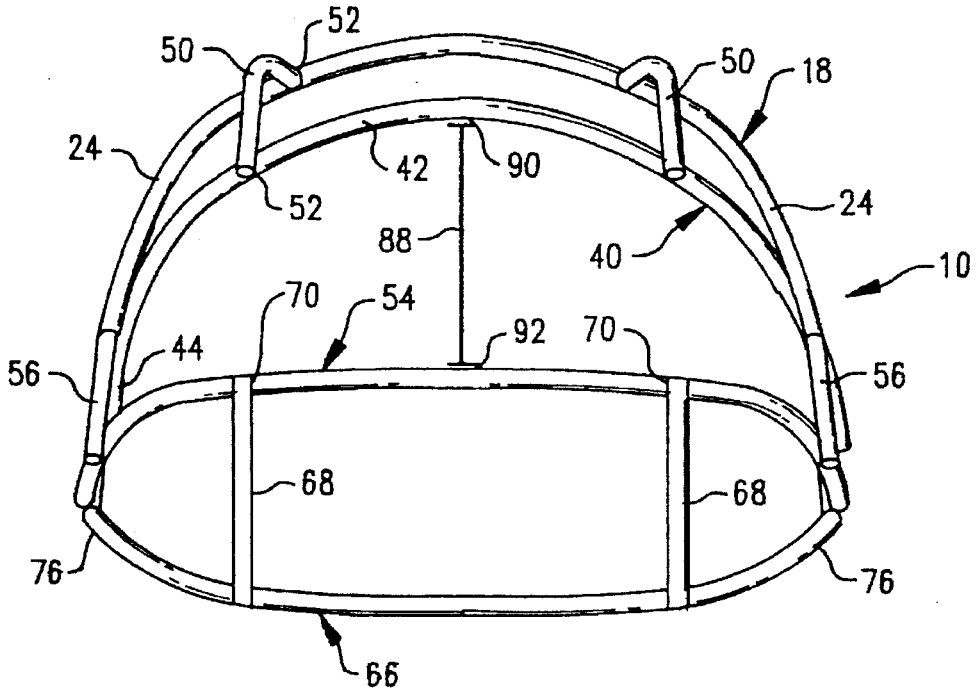
FIG. 3 is a front elevational view of the softball face guard of FIG. 1.

Referring to FIGS. 1 and 2, a critical feature of the face guard 10 of the invention is that the second bar member 40 and the third bar member 54 are collectively shaped, positioned and dimensioned to define a downwardly oriented visual aperture 80 relative to a player's eye position 82 when the face guard is mounted to the helmet 12 and the helmet is correctly seated on the player's head 14. The visual aperture between the second and third bar members generally corresponds to a clear tracking field of sight (illustrated by the arrows 84 extending from the player's eyes in FIG. 1) for the player to visually track a pitched softball approaching the player along an upward path from a point of pitched ball release. In both fast pitch and slow pitch softball, unlike baseball, the point of pitched ball release is not overhanded from an elevated pitcher's mound, but is underhanded from a level mound and the ball is generally released at a height position about level with the pitcher's thigh. Consequently, the path of the pitched ball in softball is not downward, but is generally upward relative to the player's eye position, therefore the tracking field of sight is generally downward. In this context, the face guard 10 of the invention is designed to possess a visual aperture having a maximum visual aperture width 88 between a second bar frontal midpoint 90 and a third bar frontal midpoint 92 dimensioned to minimally obstruct the player's tracking field of sight while at the same time reliably excluding a softball from striking the player's face when the softball forcefully impinges upon the face guard between the second and third bar member frontal portions.

To achieve a preferred visual aperture 80 configuration within the invention, the protective softball face guard 10 of the invention is preferably designed so that the second bar member frontal midpoint 90 is positioned at approximately the same vertical height as an eyebrow ridge of the player when the face guard is mounted to the helmet and the helmet is correctly seated on the player's head, as shown in FIG. 1, so that the second bar member 40 minimally obstructs an upper boundary (arrow 84) of the player's tracking field of sight (arrows 84, 85). A preferred design to achieve this relationship is to relatively position, configure and dimension the first bar member 16 and second bar member 40 so that the second bar member frontal midpoint 90 is separated from a first bar member frontal midpoint 94 by a maximum first and second bar separation distance 96 of less than or equal to approximately 1½ inches, and preferably by about 1⅛ to 1³⁄₁₆ inches. Referring to FIGS. 1 and 2, this design yields a narrow, non-visual aperture 98 having a maximum brim-second bar separation distance between a brim frontal midpoint 100 and the second bar frontal midpoint 90 of less than about 1 inch.

Also to achieve a preferred visual aperture 80 configuration within the invention, the third bar member frontal midpoint 92 is desirably separated from the first bar member frontal midpoint 90 by a maximum first and third bar separation distance of at least 4 inches. Even more preferably, and interrelated with this first and third bar member spatial relationship, it is desirable to position, configure and dimension the first bar member 16 and third bar member 54 so that the third bar member frontal midpoint is separated from a brim frontal midpoint 100 when the face guard 10 is correctly mounted to the helmet 12 by a brim-third bar separation distance of between approximately 4 to 4¼ inches.

In other preferred aspects of the invention, the second bar member frontal midpoint 90 is separated from the third bar member frontal midpoint 92 (see FIG. 1) by a maximum visual aperture width 88 of approximately 3¼ inches or less, which allows for reliable exclusion of high velocity softballs from penetrating the face guard 10 and striking the player's face. Precise dimensions of the maximum visual aperture may vary in conjunction with sizes of particular softballs chosen for play, which range from 11 inches in circumference all the way up to 16 inches and larger. In general, the maximum visual aperture width at the frontal midline of the mask will be approximately ¼ inch less than the diameter of the selected softball chosen for play, and the above noted width of 3¼ inches is considered preferred over the contemplated use of a variety of mask sizes to accommodate different ball sizes. Even more preferred is a maximum visual aperture width of between about 3.0–3.125 inches, which has been found satisfactory for excluding all standard sizes of softballs and still provides a superior visual aperture 80 dimension.

Other configurations of the face guard 10 of the invention having fewer or alternatively configured bar members are also contemplated, but these are not considered to represent the preferred embodiments of the invention. For example, it is possible to delete the second bar member and raise the third bar member (which would become the second bar member in such an embodiment) to define a visual aperture beginning directly below the brim 22 of the helmet. Alternatively, the fourth bar member 66 could be engineered out of the design. However, it is believed that neither of these alternative embodiments of the invention would yield the same top quality performance in terms of protection and visibility achieved by the preferred embodiments described herein.

In association with its novel bar member design and visual aperture 80 configuration, the face guard 10 of the application preferably incorporates novel vertical strut members located above and below the visual aperture, and spanning the visual aperture. In preferred embodiments, the face guard includes pairs of vertical struts between bar members, including a pair of first tier vertical strut members 50 between the first bar member 16 and the second bar member 40 that provide structural support against deformation and deflection of the bar members when they are struck forcefully. The first tier vertical strut members are desirably positioned between the first bar member frontal portion 18 and the second bar member frontal portion 42 and are more frontally positioned relative to the second tier vertical strut members 56. Likewise, preferred embodiments of the invention include a pair of third tier vertical strut members 68 that are also more frontally positioned relative to the second tier vertical strut members. More preferably, all of the first, second and third tier vertical strut members are laterally positioned relative to a frontal midline of the face guard that intersects the frontal midpoints 90, 92, 94 of the bar members, so that no vertical strut member junction points (eg. 70, 52) intersect the frontal midline.

Figure 9:
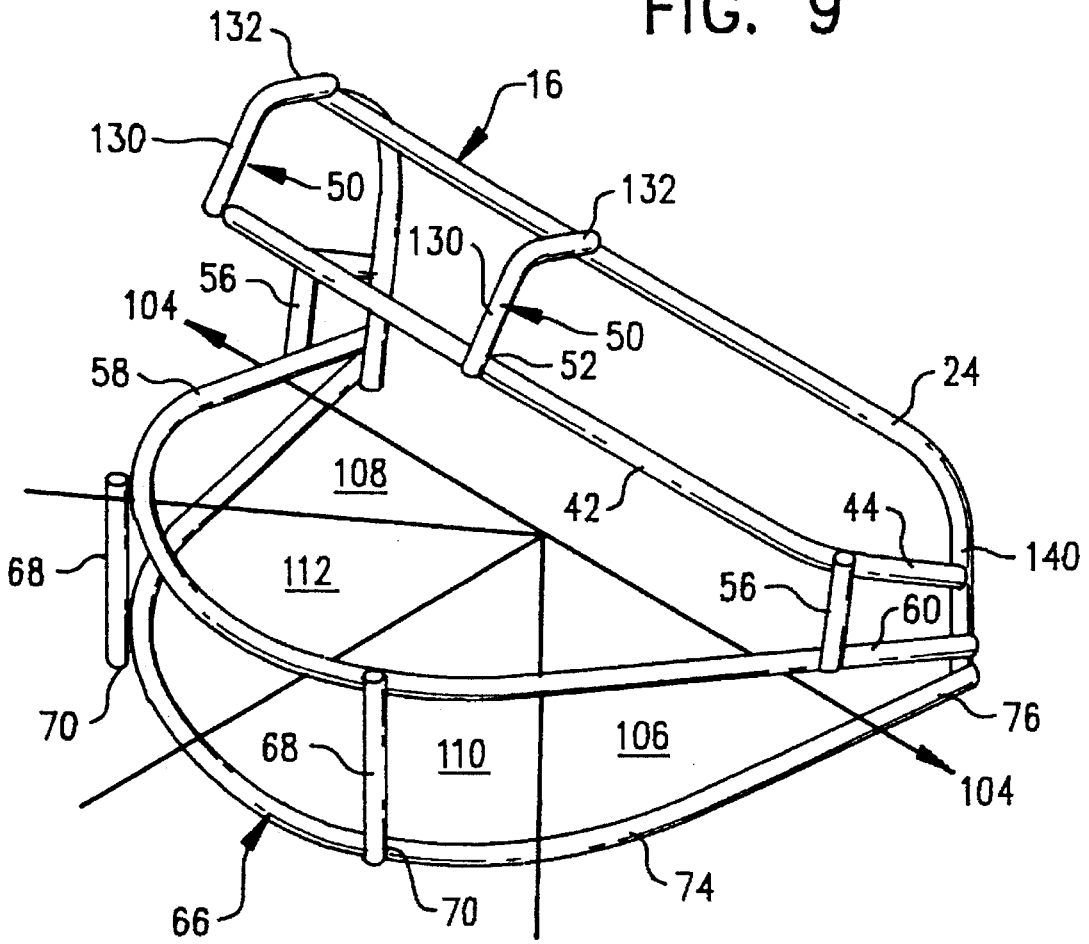
FIG. 9 is a front right perspective view of a softball face guard employing the concepts of the invention in a preferred embodiment illustrating quadrant subdivisions of a fourth bar frontal portion and placement of third tier vertical strut members relative thereto.

In more detailed embodiments of the invention, the fourth bar member frontal portion 74 forms a rough semicircular are bounded by line 104—104 in FIG. 9. This semicircular arc defines a left fourth bar member fronto-lateral quadrant 106, a right fourth bar member fronto-lateral quadrant 108, a left fourth bar member frontal quadrant 110, and a right fourth bar member frontal quadrant 112. Also in this embodiment, the third tier vertical strut members 68 are frontally positioned relative to the left and right fourth bar member fronto-lateral quadrants, so that third tier vertical strut junction points 70 are confined within the left and right fourth bar member frontal quadrants 110, 112. This configuration is important within the invention for both strengthening and visibility purposes.

Figure 4:
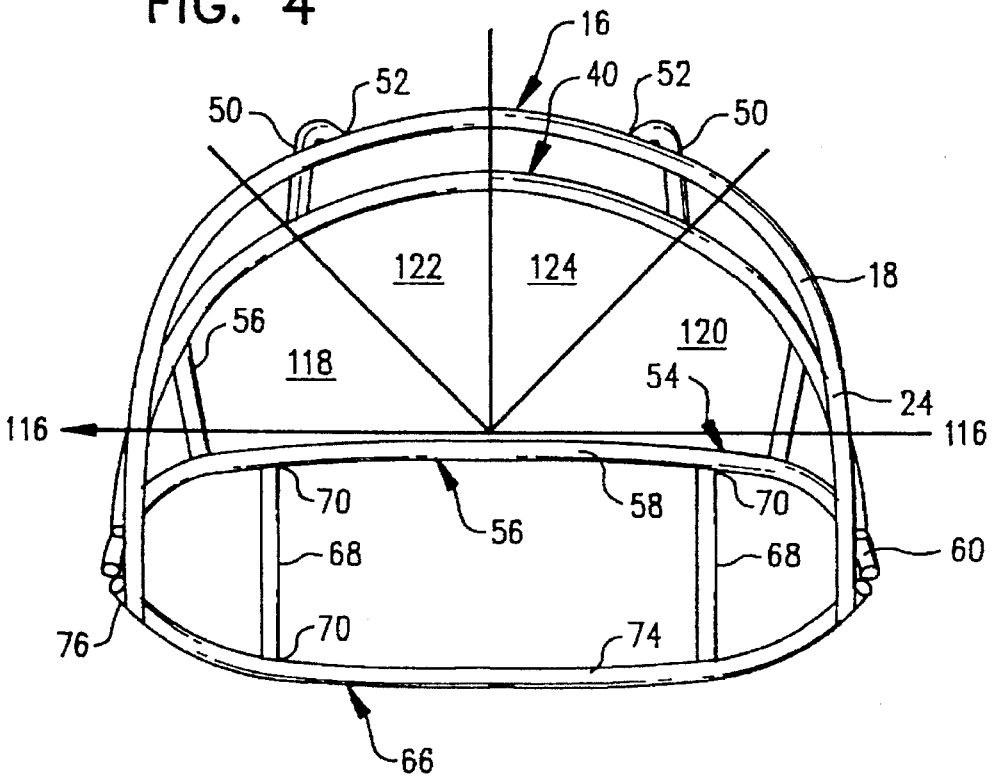
FIG. 4 is a rear elevational view of the softball face guard of FIG. 1.
Figure 5:
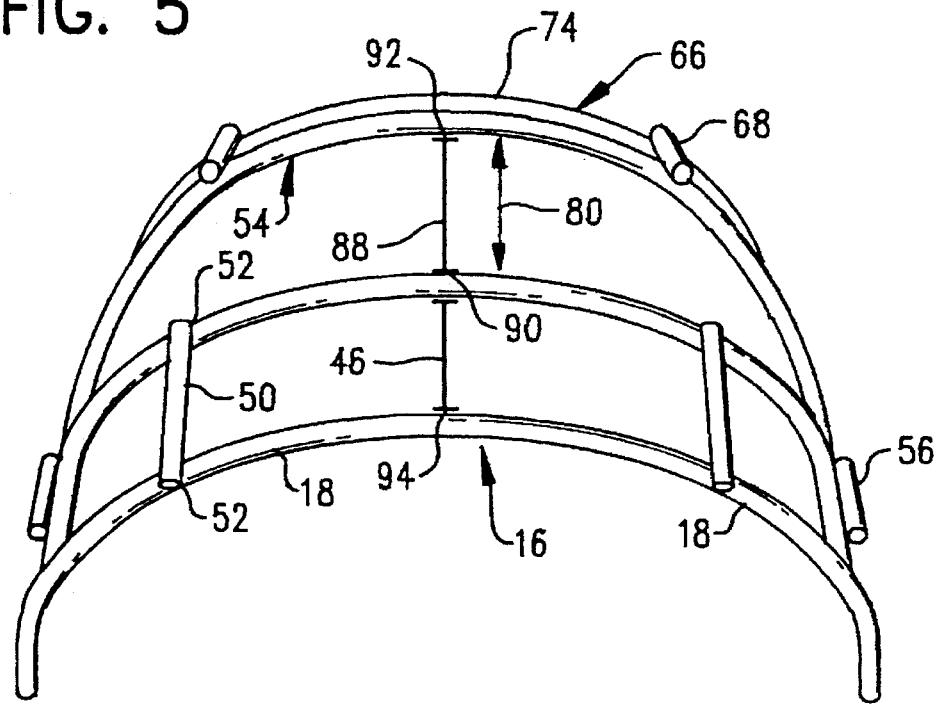
FIG. 5 is a top plan view of the softball face guard of FIG. 1.
Figure 6:
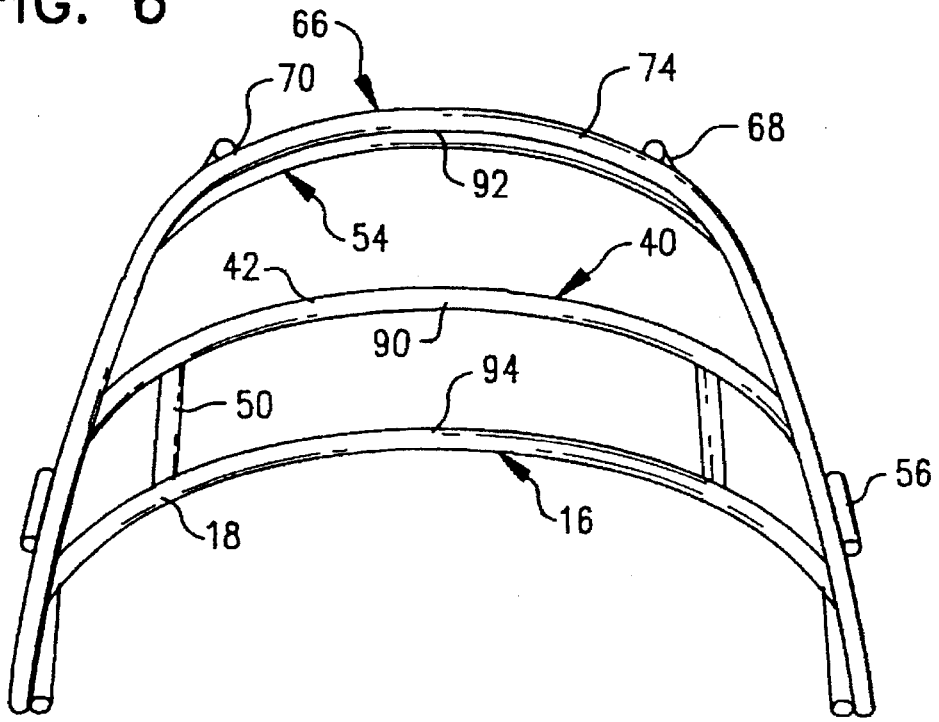
FIG. 6 is a bottom plan view of the softball face guard of FIG. 1.

In another detailed embodiment of the invention, the first bar member frontal portion also forms a rough semicircular are, bounded by line 116—116 in FIG. 4. This semicircular arc defines a left first bar member fronto-lateral quadrant 118, a right first bar member fronto-lateral quadrant 120, a left first bar member frontal quadrant 122, and a right first bar member frontal quadrant 124. Also in this embodiment, the first tier vertical strut members 50 are frontally positioned relative to the left and right first bar member fronto-lateral quadrants, so that first tier vertical strut junction points 70 are confined within the left and right first bar member frontal quadrants 122, 124. This configuration is also important within the invention for strengthening and visibility purposes.

Figure 7:
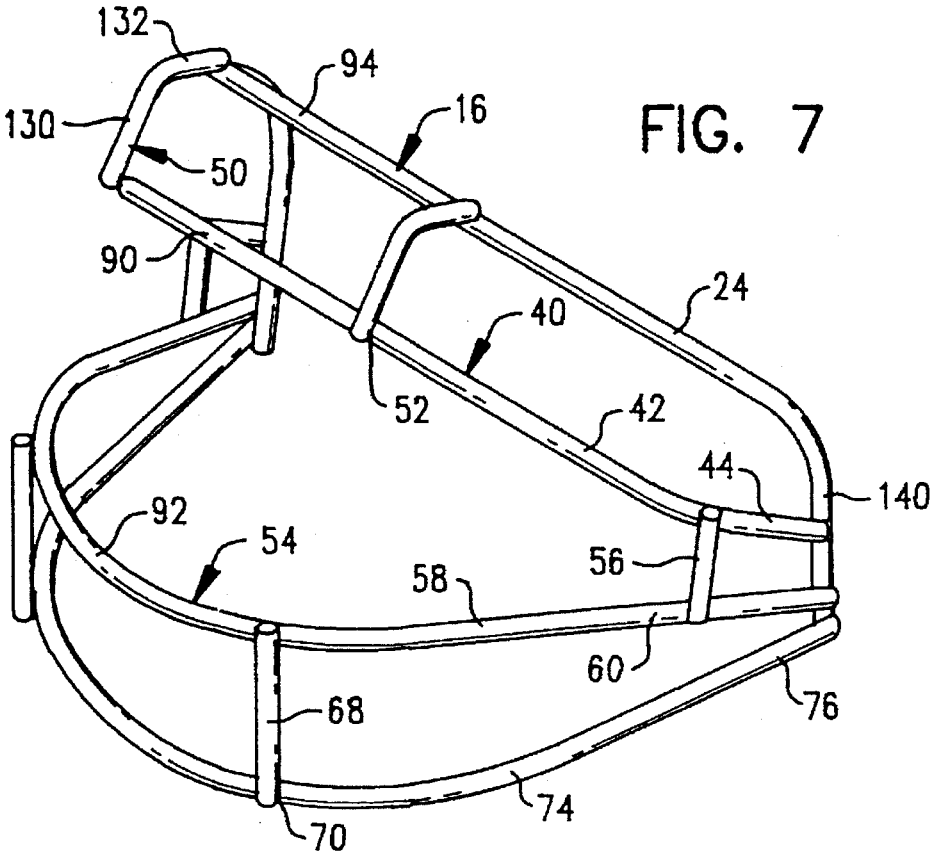
FIG. 7 is a front right perspective view of a softball face guard employing the concepts of the invention in an embodiment having an alternate second tier vertical strut placement.
Figure 8:
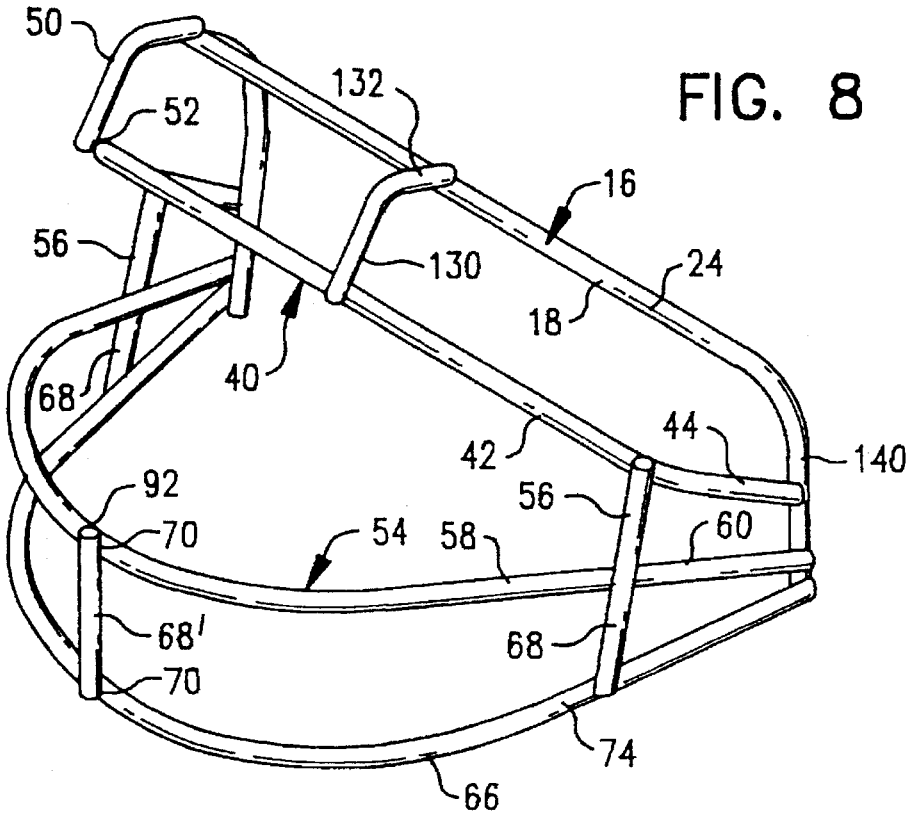
FIG. 8 is a front right perspective view of a softball face guard employing the concepts of the invention in an embodiment having an alternate second and third tier vertical strut placement and configuration.

In alternate preferred embodiments depicted in FIGS. 7 and 8, the configuration of vertical strut members can be adjusted respectively, such that the novel visual and impact shielding attributes of the face guard 10 are conserved. For example, the embodiment of FIG. 7 shows the second tier vertical struts 56 shifted rearward relative to the line 104—104 in FIG. 9 marking the boundary of the fourth bar member frontal portion 74. This rearward configuration of the second tier vertical struts shifts the struts rearward of a rear boundary of a player's field of vision to minimally obstruct the players's tracking field of sight 84, 85. While this design allows for somewhat more flex between the second bar member 40 and third bar member 54 in the event of a strong frontal impact by an errant softball pitch or throw, the adjustment can be accommodated by either narrowing the maximum visual aperture width 88, or by relatively adjusting the number, position or configuration of the first tier vertical struts 50 and/or third tier vertical struts 68. One example of a suitable, relative adjustment of vertical strut number, position and configuration, unrelated to the rearward shift of second tier struts 56 discussed above, is depicted in FIG. 8. In this embodiment of the invention, the second tier vertical struts are not shifted rearwardly, but are joined in a unitary, multi-tier strut combination wherein the second tier struts are continuous with paired third tier struts 68. This placement and configuration provides additional shielding from lateral impacts, and also limits bar flex in this area of the face guard. However, this placement and configuration differs from the above described placement and configuration with regard to the third tier vertical struts, which were previously described as paired and located within the frontal quadrants 110, 110 relative the fourth bar member 66. In the embodiment shown in FIG. 8, with two third tier struts placed rearward of the frontal quadrants of the fourth bar member, it is desirable to add at least a third, third tier strut member 68', which in this case is preferably positioned so that its vertical strut member junction points 70 lie along the frontal midline of the face guard intersecting the third bar member frontal midpoint 92, as shown.

In yet additional preferred embodiments of the invention, the first tier vertical strut members 50 are generally arcuate, as best seen in FIGS. 1 and 9. More specifically, the first tier vertical struts have an upwardly depending lower strut segment 130 and rearwardly depending upper segments 132, whereby the overall shape of the first tier vertical struts is adapted to conform to a frontal edge 134 of the brim 22 of the helmet 12 and facilitate optimal seating and positioning of the face guard 10.

In perhaps its simplest, and therefore most preferred, design, the face guard 10 of the invention incorporates an even more integrated construction, wherein all of the bar elements are rearwardly joined by a single vertical strut member. In one such embodiment depicted in FIGS. 1 and 2, the first bar member rear leg portions 24 each terminate in a downwardly depending terminal leg segment 140. These terminal leg segments form vertical struts to which the rear leg portions 44, 60 and 76 of the second, third and fourth bar member, 40, 54 and 66 respectively, are each rigidly connected at their termini.

Manufacture of the face guard 10 and its component parts and fittings can be accomplished using a variety of well known materials and fabrication processes. Preferably, all of the bar members and vertical strut members are formed of a bent, light gauge metal rod material, such as carbon steel rod, having a rod diameter of approximately ¼ inch or less. The rod material is preferably coated by a light absorbing (eg. black or matte finish), flexible coating, such as rubber or latex. While it is preferred to use welded carbon steel to which a rubberized coating is applied after welding, it is also suitable to use high impact plastics, nylon, cast aluminum and other polymeric or metal materials for constructing the face guard.

Mounting of the face guard 10 to the helmet 12 is readily accomplished using a variety of connecting means widely used for baseball face guards. Preferably, the face guard is mounted to a pre-drilled helmet using nylon straps 146 that embrace the bar elements and anchor through the brim 22 and ear flags 26 of the helmet using a combination of ordinary bolts and threaded grommets or nuts. These mounting materials provide a resilient anchor means for flexibly, but firmly and reliably, mounting the guard to withstand shock without breaking loose or damaging the helmet. Further, the use of nylon straps allows the face guard 10 to be readilyu cut away from the player's face in the event of serious injury. However, other mounting methods and materials that satisfy these requirements can be readily substituted, as will be understood by those skilled in the art.

Depending on the materials used for constructing the face guard 10, the component bars and struts of the guard can be interconnected by various conventional methods, including gluing, heat welding and sonic welding, among others. Alternatively, all or part of the guard can be manufactured as a unitary article without assembly and bonding of component parts. For example multiple bar and/or strut elements can be fabricated into a partial or complete face guard by casting, injection molding or other like fabrication processes known in the art.

Those with ordinary skill in the art will appreciate that other embodiments, adaptations and variations of the invention are possible which employ the same inventive concepts described above. Therefore, the invention is not to be limited by the above disclosure, but is to be determined in scope by the claims which follow.

What is claimed is:

1. A protective softball face guard attachable to a baseball helmet having a frontally extending brim, said face guard adapted to protect against facial injuries during softball activities, comprising:

a first bar member made of a rigid, impact resistant material, said first bar member having a generally semicircular first bar member frontal portion adapted to seat atop an upper surface of a frontally extending brim of the baseball helmet when the face guard is mounted to the helmet, and rearwardly extending first bar member rear leg portions extending rearwardly from the first bar member frontal portion beyond the brim in close juxtaposition to paired lateral ear flagflaps of the helmet when the face guard is mounted to the helmet;

a second bar member made of a rigid, impact resistant material positioned below the first bar member and rigidly connected thereto by a first tier vertical strut member, said second bar member having a generally semicircular second bar member frontal portion positioned below the brim when the face guard is mounted to the helmet, and rearwardly extending second bar member rear leg portions extending rearwardly from the second bar member frontal portion beyond the brim in close juxtaposition to the paired lateral ear flagflaps when the face guard is mounted to the helmet;

a third bar member made of a rigid, impact resistant material positioned below the second bar member and rigidly connected thereto by a second tier vertical strut member, said third bar member having a generally semicircular third bar member frontal portion, and rearwardly extending third bar member rear leg portions extending rearwardly from the third bar member frontal portion beyond the brim in close juxtaposition to the paired lateral ear flagflaps when the face guard is mounted to the helmet; and a fourth bar member made of a rigid, impact resistant material positioned below the third bar member and rigidly connected thereto by a third tier vertical strut member, said fourth bar member having a generally semicircular fourth bar member frontal portion, and rearwardly extending fourth bar member rear leg portions extending rearwardly from the fourth bar member frontal portion beyond the brim in close juxtaposition to the paired lateral ear flagflaps when the face guard is mounted to the helmet, wherein said second and third bar members are shaped, positioned and dimensioned to define a downwardly oriented visual aperture relative to a player's eye position when the face guard is mounted to the helmet and the helmet is correctly seated on the player's head, said visual aperture generally corresponding to a clear tracking field of sight for the player to visually track a pitched softball approaching the player along an upward path from a point of pitched ball release, said visual aperture having a selected visual aperture width to minimally obstruct the player's tracking field of sight while at the same time reliably excluding a softball from striking the player's face when the softball forcefully impinges upon the face guard between the second and third bar member frontal portions, and wherein a third bar member frontal midpoint is separated from a first bar member frontal midpoint by a maximum first and third bar separation distance of at least four inches.

2. The protective softball face guard of claim 1, wherein said third bar member frontal midpoint is separated from a midpoint of said brim when the face guard is correctly mounted to the helmet by a brim-third bar separation distance of between about four and one quarter inches.

3. The protective softball face guard of claim 1, including third tier vertical strut members consisting of a pair of third tier vertical strut members frontally positioned relative to a pair of second tier vertical strut members and substantially displaced laterally relative to a frontal midline of the face guard so as to lie within left and right fourth bar member fronto-lateral quadrants defined by a frontal portion of the fourth bar member.

4. The protective softball face guard of claim 1, including first tier vertical strut members consisting of a pair of first tier vertical strut members and a third tier vertical strut members consisting of a pair of third tier vertical strut members all of said first tier and third tier strut members frontally positioned relative to a pair of second tier vertical strut members, wherein all of said first and third tier vertical strut members are substantially displaced laterally relative to a frontal midline of the face guard so as to lie within left and right fourth bar member fronto-lateral quadrants defined by a frontal portion of the fourth bar member.

5. The protective softball face guard of claim 1, wherein a lower boundary of said visual aperture corresponding in vertical position to a frontal midpoint of one of said bar members is separated from a frontal midpoint of said brim by a brim-third bar separation distance of between about 4 to 4¼ inches.

6. A protective softball face guard attachable to a baseball helmet to protect against facial injuries during softball activities, comprising: a grid of rigid, curved bar members rigidly interconnected by vertical strut members, said grid forming a generally concave shield surrounding a player's face when the face guard is correctly mounted to the helmet and the helmet is correctly seated on the player's head, said bar members defining a downwardly oriented visual aperture relative to a player's eye position when the face guard is mounted to the helmet and the helmet is correctly seated on the player's head, said visual aperture generally corresponding to a clear tracking field of sight for the player to visually track a pitched softball approaching the player along an upward path from a point of pitched ball release, said visual aperture having a selected visual aperture width to minimally obstruct the player's tracking field of sight while at the same time reliably excluding a softball from striking the player's face when the softball forcefully impinges upon the face guard, wherein a frontal midpoint of one of said bar members is vertically positioned at approximately the same vertical position as a player's eyebrow ridge when the face guard is mounted to the helmet and the helmet is correctly seated on the player's head so that said one of said bar members minimally obstructs an upper boundary of the player's tracking field of sight, and wherein said frontal midpoint of said one of said bar members is separated from a frontal midpoint of said brim by a narrow, non-visual separation distance of less than about 1 inch.

7. A protective softball face guard attachable to a baseball helmet to protect against facial injuries during softball activities, comprising:

a first bar member made of a rigid, impact resistant material, said first bar member having a generally semicircular first bar member frontal portion adapted to seat atop an upper surface of a frontally extending brim of the baseball helmet when the face guard is mounted to the helmet, and rearwardly extending first bar member rear leg portions extending rearwardly from the first bar member frontal portion beyond the brim in close juxtaposition to paired lateral ear flagflaps of the helmet when the face guard is mounted to the helmet;

a second bar member made of a rigid, impact resistant material positioned below the first bar member and rigidly connected thereto by a pair of first tier vertical strut members, said second bar member having a generally semicircular second bar member frontal portion positioned below the brim when the face guard is mounted to the helmet, and rearwardly extending second bar member rear leg portions extending rearwardly from the second bar member frontal portion beyond the brim in close juxtaposition to the paired lateral ear flagflaps when the face guard is mounted to the helmet;

a third bar member made of a rigid, impact resistant material positioned below the second bar member and rigidly connected thereto by a pair of second tier vertical strut members, said third bar member having a generally semicircular third bar member frontal portion, and rearwardly extending third bar member rear leg portions extending rearwardly from the third bar member frontal portion beyond the brim in close juxtaposition to the paired lateral ear flagflaps when the face guard is mounted to the helmet; and a fourth bar member made of a rigid, impact resistant material positioned below the third bar member and rigidly connected thereto by a pair of third tier vertical strut members, said fourth bar member having a generally semicircular fourth bar member frontal portion, and rearwardly extending fourth bar member rear leg portions extending rearwardly from the fourth bar member frontal portion beyond the brim in close juxtaposition to the paired lateral ear flagflaps when the face guard is mounted to the helmet, wherein said second and third bar members are shaped, positioned and dimensioned to define a downwardly oriented visual aperture relative to a player's eye position when the face guard is mounted to the helmet and the helmet is correctly seated on the player's head, said visual aperture generally corresponding to a clear tracking field of sight to visually track a pitched softball approaching the player along an upward path from a point of pitched ball release, said visual aperture having a selected visual aperture width to minimally obstruct the player's tracking field of sight while at the same time reliably excluding a softball from striking the player's face when the softball forcefully impinges upon the face guard between the second and third bar member frontal portions, wherein said first tier vertical strut members are generally arcuate, having rearwardly depending first tier strut upper segments adapted to conform to a frontal edge of the brim of said helmet.

* * * * *